US005363725A

United States Patent [19]

Cellini

[11] Patent Number: 5,363,725

[45] Date of Patent: Nov. 15, 1994

[54] CORKSCREW WITH FITTING TO SHEAR THE TINFOIL, PLASTIC OR OTHER CAPS ON THE NECK OF BOTTLES

[76] Inventor: Ferdinando Cellini, Via Percoto 11, 33085 Maniago (PN), Italy

[21] Appl. No.: 64,926

[22] Filed: May 24, 1993

[30] Foreign Application Priority Data

Jun. 11, 1992 [IT] Italy ..... UD92U000023
Jun. 30, 1992 [IT] Italy ..... UD92U000027

[51] Int. Cl.[5] ..... B67B 7/44

[52] U.S. Cl. ..... 81/3.09; 81/3.36; 81/3.35; 7/156; 30/1.5

[58] Field of Search ..... 7/151, 155, 156; 81/3.07, 3.09, 3.37, 3.29, 3.35, 3.36, 3.45; 30/1.5

[56] References Cited

U.S. PATENT DOCUMENTS 4,845,844 7/1989 Allen ..... 30/1.5

FOREIGN PATENT DOCUMENTS 0220850 5/1987 European Pat. Off. ..... B67B 7/04
1273285 11/1960 France ..... B67B 7/44
193734 12/1906 Germany ..... B67B 7/44
839319 5/1952 Germany ..... B67B 7/44
WO91/18822 6/1990 WIPO ..... 7/44

*Primary Examiner*—Roscoe V. Parker
*Attorney, Agent, or Firm*—Antonelli, Terry, Stout & Kraus

[57] ABSTRACT

Corkscrew (10) with a fitting (16) to shear tinfoil, plastic or other caps (17) on the upper part of the neck (18) of bottles (14) possibly including a collar, the corkscrew (10) comprising an at least partly flat grip (11) having a possible zone to contain a drawing screw (12), an element to anchor the drawing screw (12) and a short supporting element (13), cutting fitting (16) being included and consisting of small shearing wheel (22) cooperating with recess (19), which are substantially coherent with the outer diameter of the neck (18) of the bottle (14) and are associated with positioning and guide members (19-20-30-23) cooperating with the upper part of the neck (18) of the bottle (14).

10 Claims, 4 Drawing Sheets

CORKSCREW WITH FITTING TO SHEAR THE TINFOIL, PLASTIC OR OTHER CAPS ON THE NECK OF BOTTLES

BACKGROUND OF THE INVENTION

This invention concerns a corkscrew with a fitting to shear the tinfoil, plastic or other caps on the neck of bottles.

To be more exact, the invention concerns a corkscrew which is advantageously, but not only, of a type which can be carried in the pocket, is used to extract corks or crown corks and is equipped with a fitting able to shear the tinfoil, plastic or other cap that normally covers the upper part of the neck of bottles, this shearing fitting being provided directly on the grip of the corkscrew.

The normal practice is that the neck of bottles is covered with a cap consisting of a tinfoil, plastic or other sheet, which may be more or less strong and performs mainly aesthetic functions besides protecting the cork or metallic crown cork.

This cap is firmly fixed to the neck of the bottle and can be removed by hand only with some difficulty.

The normal practice is to draw the cork from the bottle without removing at least part of the cap beforehand. The outcome of this practice is that, when the liquid is poured from the bottle, the liquid comes into contact with the remnants of the torn cap, thus leading to obvious hygienic and unsightly shortcomings.

Fittings have been disclosed which are suitable to remove at least the upper part of the cap.

One embodiment disclosed in EP-A-0220850 includes an element which consists advantageously of a plastic material, is shaped as a "U" or opposed double "C", is resilient and is equipped with small shearing wheels on its inner sides. These small shearing wheels are made to cooperate with the neck of the bottle and to shear the cap circumferentially.

This embodiment entails the drawback of requiring the use of an additional element, which is not an integral part of the corkscrew and may therefore become lost and anyway is not practical nor quick to use.

Moreover, these small wheels have their peripheral bevelled portion facing upwards, and so the upper edge of the lower part of the tinfoil cap still attached to the bottle stays slightly separated from the neck of the bottle, thus involving the risk that the user may cut himself, and also the problem of drops of liquid seeping into the space created between the remainder of the tinfoil cap and the neck of the bottle.

Furthermore, the force applied to the small shearing wheel tends to unhinge that wheel from the element which supports and connects it to the grip of the corkscrew, thus making the shearing fitting unusable.

Moreover, this fitting enables the cap to be sheared along only one circumference since the bottom wall of the fitting has to cooperate with the top of the neck of the bottle during the shearing of the cap.

The variant of this corkscrew has a shearing fitting forming an integral part of the corkscrew but possesses a great overall bulk without overcoming the above drawbacks.

Other known corkscrews include a fitting pivoted rotatably on the grip of the corkscrew and comprising two small shearing wheels plus two small wheels in the handle. In this way the shearing fitting grasps the neck of the bottle so that the four small wheels cooperate with the cap.

This fitting does not overcome the above problems and is also very bulky and costly besides being not very easy to handle or keep in the pocket.

Another embodiment, which is disclosed in IT-199,869, discloses a corkscrew equipped, along its grip, with a recess or a protruding profile with sharp or serrated edges, which are caused to act on the cap.

This embodiment entails the drawback of often bringing the sharp or serrated edges into contact with the hand and therefore may cause small accidents or at least discomfort for a user.

Besides, if these corkscrews are kept in a pocket, the sharp elements will cut the fabric or be caught therein.

Corkscrews are also known in which the shearing fitting consists of a blade (FR-A-1.273,285) or of a small shearing wheel (DE-C-193.734) and is rotatably pivoted on the grip of the corkscrew. These systems not only require additional opening/closing movements to bring the shearing fitting from a retracted inactive position to a working position and viceversa but also do not include means for the proper positioning of the shearing tool on the neck of the bottle.

WO-A-9118822 discloses a corkscrew in which the fitting to shear the cap consists of a protruding blade associated with an arc-shaped formation machined in the handle of the corkscrew. This embodiment does not ensure a clean, accurate shearing of the cap.

In the corkscrew shown in DE-C-839,319 the shearing fitting comprises a plurality of shearing wheels, one of which is associated with a lever that has to be actuated to make the shearing wheel cooperate with the neck of the bottle during the whole shearing operation. The wheels shown include two bevels, an upper bevel and lower bevel respectively, which not only shear the cap but also fold and stick to the neck of the bottle the upper edge of the lower part of the sheared tinfoil cap remaining attached to the bottle after the shearing step.

The upwardly facing bevel of the shearing wheels makes the sheared part of the cap stick to the glass of the bottle, and this situation may cause problems when this sheared part of the cap has to be detached, thus giving results which are not always satisfactory.

The shearing fittings of the state of the art do not include positioning and guide means which, in cooperation with the top or collar of the bottle, prevent the slipping and/or sliding of the shearing element along the neck of the bottle so as to obviate inaccurate shearing of the cap.

SUMMARY OF THE INVENTION

The present applicant has designed, tested and embodied this invention so as to overcome the shortcomings of the state of the art and to achieve further advantages.

The purpose of the invention is to provide a corkscrew, advantageously but not only a pocket corkscrew, to draw corks or crown corks, which comprises a fitting able to shear at least the upper part of the caps which cover the upper part of the neck of bottles.

In the disclosure and drawings hereinafter we shall refer to a corkscrew of a pocket corkscrew type including a screw to be screwed into the cork and employing the support of the lever acting as a grip, but the invention can be applied also to other types of corkscrews which can be used for corks or crown corks and can be kept in the pocket or otherwise.

In the corkscrews according to the invention the fitting to shear the cap is an integral part of the corkscrew and is machined directly in the end portion of the grip of the corkscrew so as not to cause problems as regards handling or being kept in a pocket.

This shearing fitting according to the invention and in all the variants of its embodiment comprises at least one small shearing wheel including on its periphery a bevelled edge with its bevel facing the bottom of the bottle; this bevelled edge has the task of shearing the tinfoil cap and causing to adhere to the neck of the bottle the upper edge of the lower part of the tinfoil cap still adhering to the glass of the bottle after the shearing step.

The upper part of the cap undergoes a clean cut, which does not make the cap adhere to the glass but rather, on certain occasions, deforms and enlarges the cap and assists removal of the sheared part of the cap.

Moreover, during the shearing step the force exerted by the shearing wheel on the neck of the bottle is discharged partly on the axis of the wheel and thus obviates detachment of the wheel from the rivet acting as its shaft.

Guide and positioning means are associated with the shearing fitting according to the invention and cooperate with the top of the neck of the bottle and/or with the collar in the high part of the neck of the bottle. These guide and positioning means ensure a clean, accurate shearing of the cap at a determined height.

According to a first idea of the embodiment the end part of the grip of the corkscrew includes a recess shaped substantially as an arc of a circle, in the outer edge of which is provided a flat circular seating in which is installed a small shearing wheel free to rotate in relation to the grip of the corkscrew and secured axially so as to protrude partly within the recess. This shearing wheel is associated with a shaft consisting of a rivet or another analogous means, which is lodged on the grip of the corkscrew and enables the wheel to rotate.

By acting with rotation and pressure on the grip of the corkscrew or on the bottle, the shearing wheel is made to cooperate with the tinfoil cap and produces a circumferential cut therein.

Depending on the depth of the recess, the shearing wheel will be positioned above the collar of the bottle or at an intermediate point on the collar, with a resulting cutting of the cap at an upper plane or intermediate plane on the collar.

According to a variant the grip may advantageously have the inner end of the recess protruding sideways from the grip so as to obtain greater support on the top of the neck of the bottle.

According to another variant a small guide wheel with a cylindrical edge cooperates with the edge of the recess and has the purpose of assisting rotary movement between the neck of the bottle and the grip of the corkscrew.

According to a variant the guide wheel has a bevel facing towards the top of the bottle.

According to yet another variant the guide wheel is replaced by a second shearing wheel.

According to a second form of embodiment the arc-shaped recess has a generating axis inclined in relation to a line normal to the median plane of the position of the grip, so as to enable the shearing fitting to cooperate with the neck of the bottle at a given angle which is not a right angle. In this case the small wheels, whether they be a shearing wheel and guide wheel respectively or are both shearing wheels, lie on the same single plane substantially at a right angle to the generating axis of the recess.

This makes more effective the use of such a tool and therefore enables more coherent pressure to be exerted and greater shearing accuracy to be achieved at the neck of the bottle.

A further idea of this embodiment arranges that the substantially arc-shaped recess extends along the whole thickness of the grip.

In this case one or two flat circular seatings, in which are installed two shearing wheels or a small shearing wheel and a small guide wheel respectively, are machined on both the outer edges of the recess.

These small wheels may be coaxial or be offset from each other.

According to one embodiment the distance between the shearing wheels at the two ends of the recess is substantially the same as the width of the collar on the upper part of the neck of the bottle.

In this case one wheel is rested on the upper edge of that collar acting as a reference mark, whereas the other wheel is positioned at the lower edge of the collar; the cap can be sheared by one wheel or the other or by both.

According to yet another variant, the upper wheels have a greater diameter than the lower wheels so as to provide a supporting surface on the upper edge of the collar.

Depending on the distance between the upper wheel and the lower wheel, the cut is made at an intermediate position on the collar or below the collar.

According to another variant the corkscrew comprises a ledge in a terminal position in the substantially arc-shaped recess machined in the thickness of the grip.

At least one flat circular seating is machined on the outer surface of the grip opposite to that ledge and in correspondence with the outer edge of the recess; in this seating is installed at least one shearing wheel so as to protrude partly within the recess.

With this particular form of embodiment the shearing of the cap can be carried out without difficulty along the upper edge of the collar, along the lower edge of the collar or at any intermediate point thereon.

According to a variant two or more shearing wheels, and possibly guide wheels too, lying substantially on the same plane are included at the recess.

According to a further variant the grip of the corkscrew contains no recess, but a seating in which is positioned a shearing wheel protruding partly from the grip is machined in a substantially median intermediate plane parallel to the faces of the grip.

In that seating, according to a variant, are included at least two substantially coplanar wheels, which are shearing wheels, or a shearing wheel and a guide wheel.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
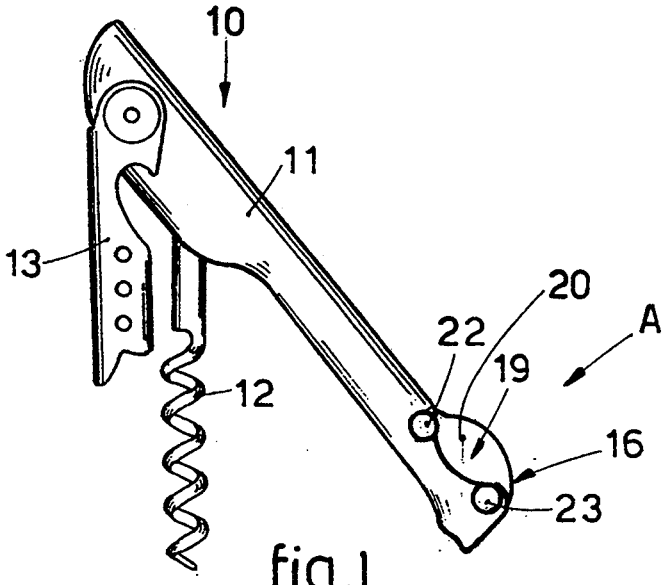
FIG. 1 shows a known type of corkscrew provided with a first form of embodiment of the shearing fitting according to the invention.

The reference number 10 in the attached figures indicates generally a corkscrew according to the invention, in which a shearing fitting 16 is an integral part of a grip 11.

In this case the corkscrew 10 is of a type which can be kept in the pocket, can draw corks 27 and consists of a grip 11, on which are pivoted a drawing screw 12 to be screwed into a cork 27 and a short element 13, which is supported on the top of a bottle 14 and makes possible the leverage action for drawing the cork 27.

The fitting 16 to shear a cap 17 surrounding the neck 18 of the bottle 14 is positioned on the end portion of the grip 11.

The shearing fitting 16 according to the invention comprises at least one small shearing wheel 22 having advantageously its edge bevelled with a bevel 26 facing the body of the bottle.

The bevel 26, besides having to shear the cap 17, has the task of making the upper edge 17a of the lower part of the cap 17 adhere to the glass of the bottle 14 after the shearing has taken place.

In this way any seepage of liquid between the cap 17 and the neck 18 of the bottle 14 and any risk of being cut by the remaining part of the cap 17 are avoided.

In the form of embodiment shown in FIGS. 1 to 4 and 13 the shearing fitting 16 is characterised by a recess 19 conformed as an arc of a circle and machined in the end part of the grip 11; the recess 19 acts as a guide and support on the top 15 of the neck 18 of the bottle 14.

Figure 2:
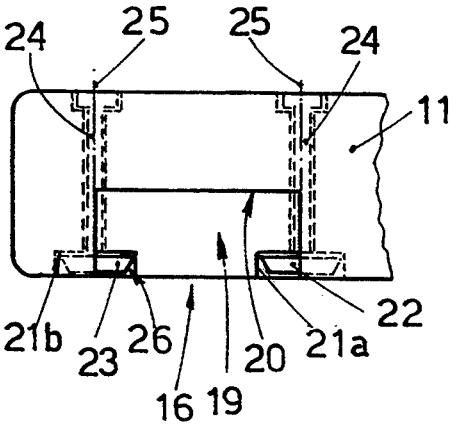
FIG. 2 gives in an enlarged scale a side view according to the arrow A of the shearing fitting of FIG. 1 according to the invention.

In the example of FIG. 2 an inner end 20 of the recess 19 lies substantially parallel to the plane on which the grip 11 lies, and protrudes advantageously from the grip 11 to increase the support surface against the top 15 of the neck 18 of the bottle 14.

In this case two flat circular seatings 21 are machined on the outer edge of the recess 19 in substantially opposed positions; in these seatings 21 are installed a small shearing wheel 22 and a small guide wheel 23 respectively, the seatings being referenced with **21*a* and 21*b*** respectively.

The small guide wheels 23 may have a cylindrical outer edge or may include a bevel facing the top of the bottle.

The shearing 22 and guide 23 wheels are secured with rivets 24, or another system suitable for the purpose, to the grip 11 so that each of them can rotate freely on its own stationary axis 25.

The shearing and guide wheels 22–23 are applied in such a way that they protrude partly into the recess 19.

According to a variant the guide wheel 23 is like the shearing wheel 22 and also has the task of shearing the cap 17.

Figure 3:
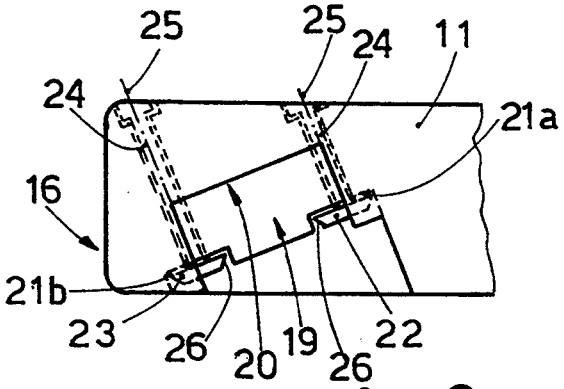
FIG. 3 shows a variant of FIG. 2.

FIG. 3 shows a second form of embodiment of the shearing fitting 16 according to the invention, wherein the recess 19 has its inner end 20 inclined in relation to the plane on which the grip 11 of the corkscrew 10 lies, thus permitting an easier mutual engagement of the bottle 14 and corkscrew 10 of the invention and a more efficient action.

In this case the shearing wheel 22 and the guide wheel 23, or second shearing wheel, rotate on the same plane parallel to the inner end 20 of the recess 19.

According to a variant the shearing fitting 16 includes only the shearing wheel 22.

Figure 4:
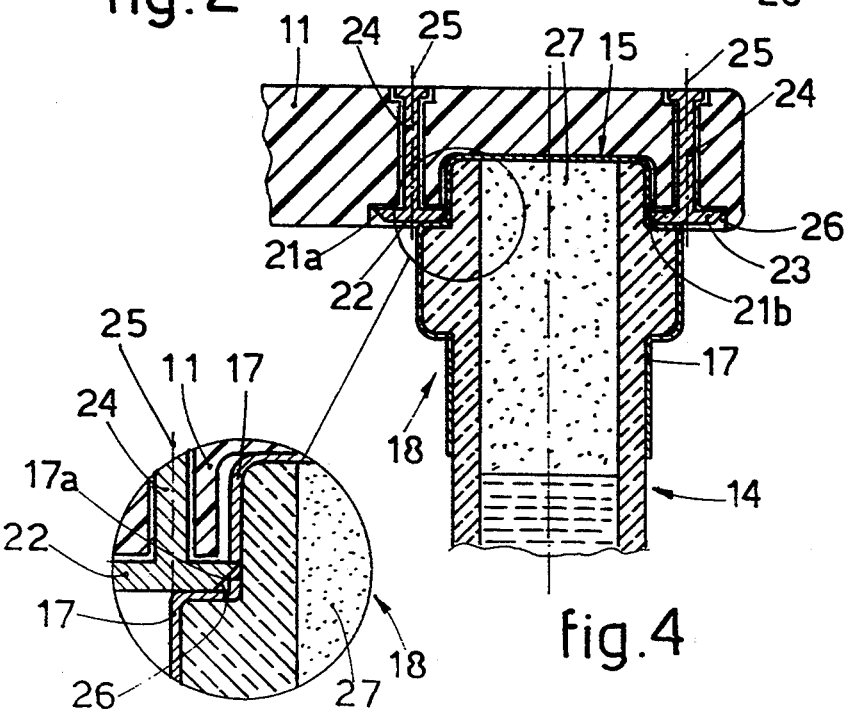
FIG. 4 shows a cross-section of the corkscrew of FIG. 2 in cooperation with the neck of a bottle during the step of shearing the tinfoil cap.

FIG. 4 shows the shearing fitting 16 of FIG. 1 applied at least partly to the neck 18 of the bottle 14 during the step of shearing the cap 17.

The shearing of the tinfoil cap 17 is effected by positioning the top 15 of the neck 18 of the bottle 14 against the inner end 20 of the recess 19, and by acting with rotation and pressure on the grip 11 of the corkscrew 10 and/or on the bottle 14; the shearing wheel 22 cuts the upper part of the cap 17 along the shearing line. This circumferential cut enables the cork 27 of the bottle 14 to be freed of obstruction by the cap 17 when the upper part of the cap 17 has been removed.

Figure 5:
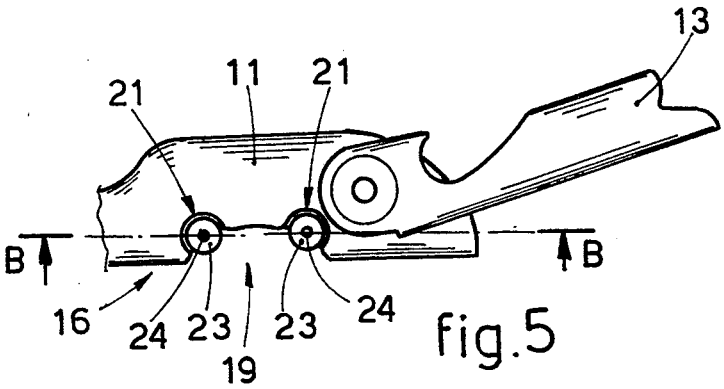
FIG. 5 is a partial plan view of a corkscrew with a second form of embodiment of the shearing fitting according to the invention.

FIG. 5 shows a second form of embodiment of the shearing fitting 16 according to the invention, wherein the recess 19 extends through the whole thickness of the grip 11.

In this case two flat circular seatings 21, in which are installed a shearing wheel 22 and guide wheel 23 respectively, are machined in the opposite faces of the grip 11 on the outer edges of the recess 19 in substantially opposite positions; the shearing and guide wheels 22–23 protrude partly into the recess 19.

In this example the shearing wheel 22 and guide wheel 23 respectively are coupled in pairs on the same axis, each pair being installed on one single rivet 24, which passes through the grip 11.

Figure 6:
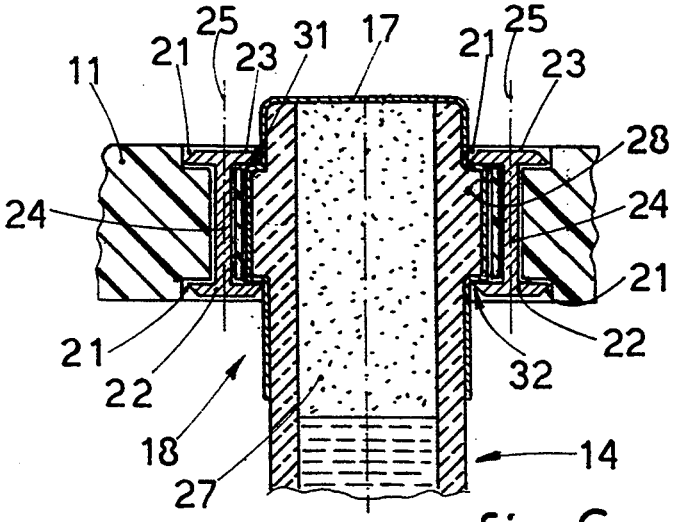
FIG. 6 shows in an enlarged scale a cross-section of the shearing fitting along the line B—B of FIG. 5 in cooperation with the neck of a bottle during the step of shearing the tinfoil cap.

In the particular case of FIG. 6 the distance between the shearing wheel 22 and guide wheel 23 is substantially the same as the width of the collar 28 on the upper part of the neck 18 of the bottle 14. In this case the guide wheel 23 is rested on the upper edge 31 of the collar 28, which acts as a reference line, whereas the shearing wheel 22 is positioned at the lower edge 32 of the collar 28, where the cap 17 is sheared.

Figure 14:
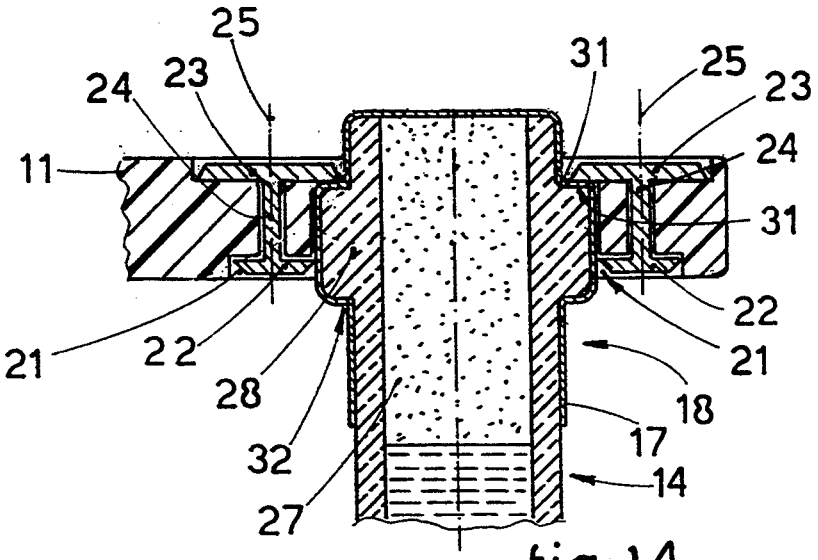

According to the variant of FIG. 14 the guide wheels 23 have a bigger diameter than the shearing wheels 22 and act as a support on the upper edge 31 of the collar 28.

If the corkscrew 10 is turned upside-down, it is possible to shear the cap 17 along the upper edge 31 of the collar 28.

According to a variant the shearing wheel 22 and guide wheel 23 are staggered in relation to each other.

Figure 8:
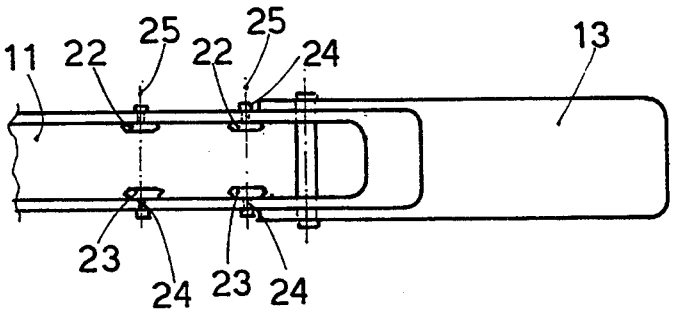
FIG. 8 is a side view of the shearing fitting according to the arrow C of FIG. 7.
Figure 7:
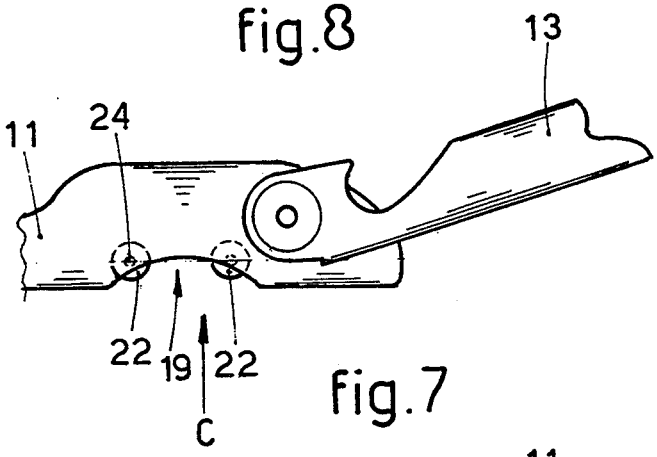
FIG. 7 is a part view of a corkscrew with a third form of embodiment of the shearing fitting according to the invention.

FIGS. 7 and 8 show a shearing fitting 16 in which the shearing and guide wheels 22–23 are positioned on the inside of the grip 11.

Figure 10:
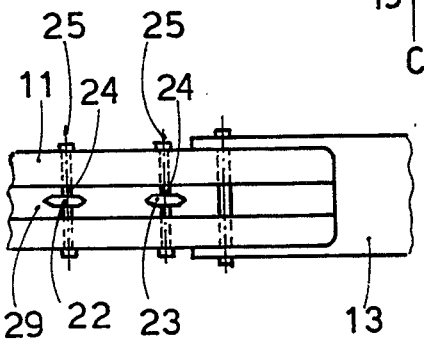
FIG. 10 shows a side view of the shearing fitting according to the invention in the direction of the arrow D of FIG. 9.
Figure 9:
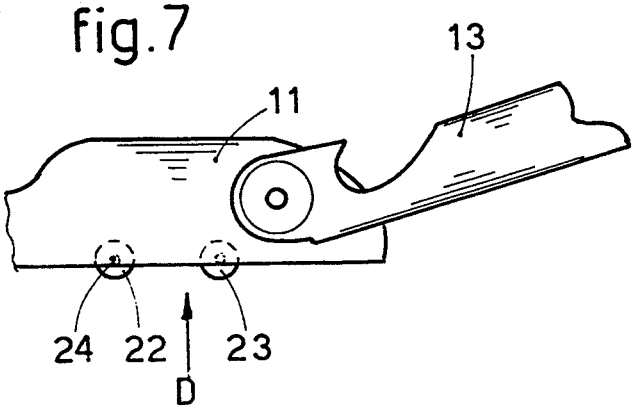
FIG. 9 is a partial plan view of a corkscrew with a fourth form of embodiment of the shearing fitting according to the invention.

In FIGS. 9 and 10 the grip 11 contains an intermediate lengthwise seating 29, within which two wheels, a shearing wheel 22 and a guide wheel 23 respectively, are positioned and lie substantially on the same plane and protrude partly from the grip 11.

Figure 11A:
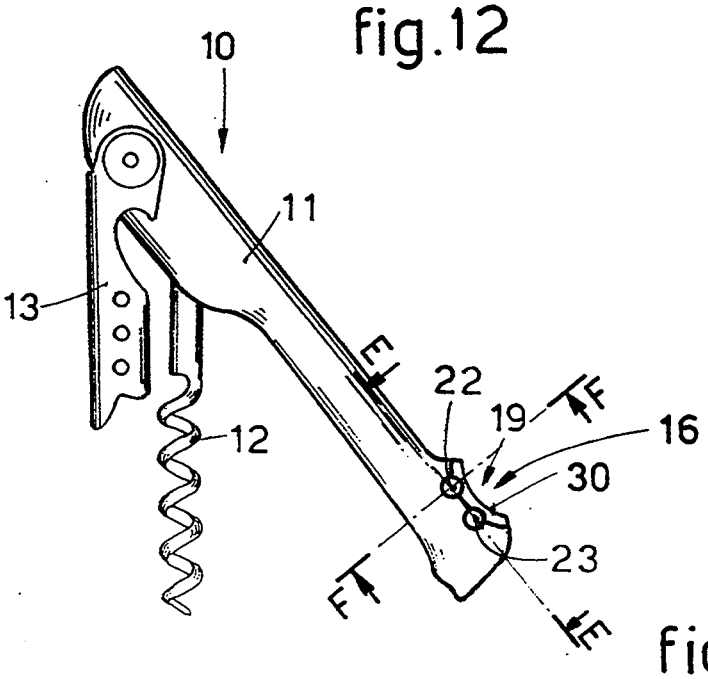
FIG. 11*a* shows a known type of corkscrew provided with a fifth form of embodiment of the shearing fitting according to the invention.
Figure 11B:
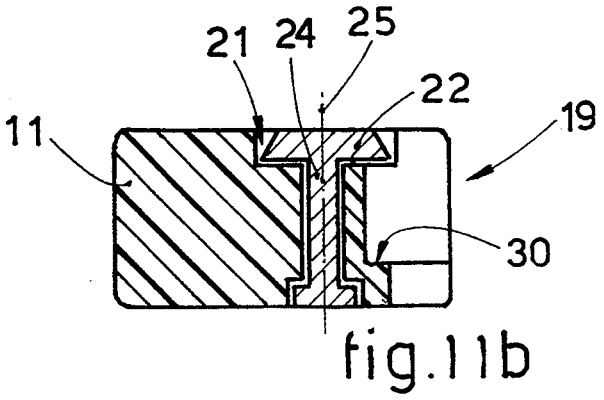
FIG. 11*b* shows in an enlarged scale a cross-section of the shearing fitting along the line F—F of FIG. 11*a;*

FIGS. 11*a* and 11*b* show another form of embodiment, wherein the recess 19 contains a ledge 30 at one side and a shearing wheel 22 at the other side, the wheel 22 being positioned so that it protrudes partly within the recess 19.

Figure 12:
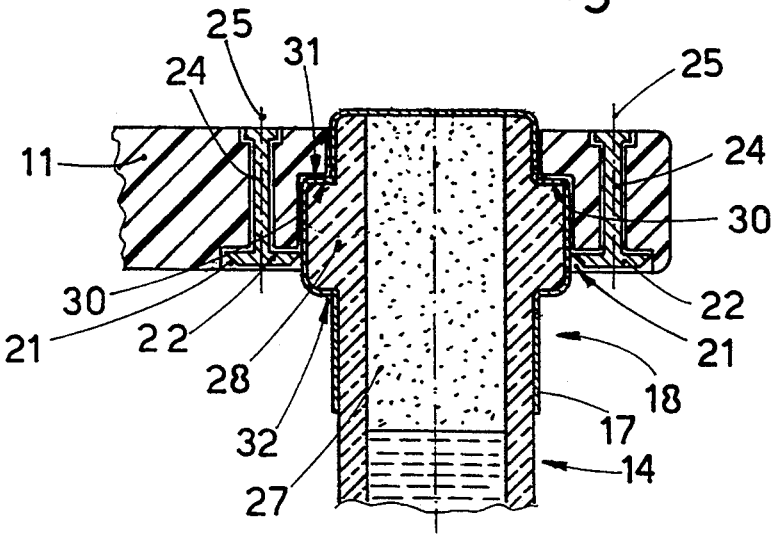
FIG. 12 shows in an enlarged scale a cross-section of the shearing fitting along the line E—E of FIG. 11 in cooperation with the neck of a bottle during the step of shearing the tinfoil cap.

The shearing of the tinfoil cap 17 can be effected substantially in three different ways as follows:

by keeping the corkscrew 10 on a plane substantially perpendicular to the axis of the bottle 14 and by resting the ledge 30 of the recess 19 on the upper edge 31 of the collar 28 of the bottle 14, the collar 28 acting as a supporting surface, and by making the outer surface of the collar 28 cooperate with the shearing wheel 22; in this case the cap 17 is cut at an intermediate position along the collar 28 (FIG. 12);

by keeping the corkscrew 10 on a plane substantially perpendicular to the axis of the bottle 14 and by making the shearing wheel 22 cooperate with the upper edge 31 of the collar 28; in this case the cut is made at the upper edge 31 of the collar 28;

by keeping the corkscrew 10 on a plane slightly inclined in relation to the plane perpendicular to the axis of the bottle 14, thus making the shearing wheel 22 cooperate with the lower edge 32 of the collar 28, while the ledge 30 is rested at an inclination on the collar 28; in this case the shearing is effected at the lower edge 32 of the collar 28.

In this case (FIGS. 11*a* and 11*b* and 12) two or more wheels are included at the recess 19 and may all be shearing wheels 22, or some may be shearing wheels 22 and others may be guide wheels 23.

Figure 13:
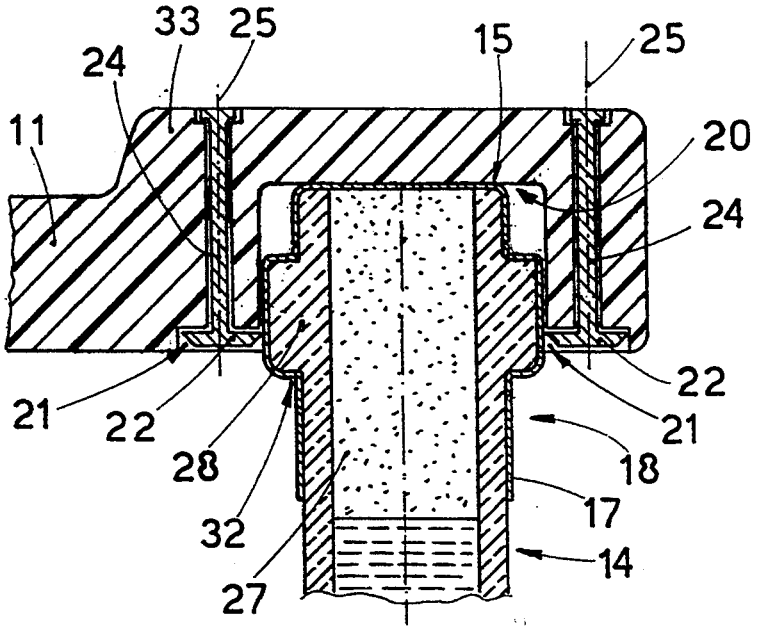
FIGS. 13 and 14 show two variants of the corkscrew according to the invention.

In FIG. 13 the grip 11 has an extra thickness 33 in correspondence with the shearing fitting 16 so as to enable a deeper recess 19 to be provided in order that the cap 17 can be sheared at an intermediate point on the collar 28.

I claim:

1. Corkscrew with a fitting to shear a cap on an upper part of a neck of a bottle comprising:

an at least partly flat grip;

a drawing screw anchored to the grip;

a short supporting element anchored to the grip;

at least one small shearing wheel cooperating with a recess provided on an outer edge of the grip, the recess being shaped so as to cooperate with the outer diameter of the neck of the bottle; and positioning and guide means associated with said recess and cooperating with the upper part of the neck of the bottle.

2. Corkscrew (10) as in claim 1, in which an outer periphery of the at least one small shearing wheel consists of a bevel oriented to be facing towards a bottom of the bottle when the positioning and guide means cooperates with the upper part of the neck of the bottle.

3. Corkscrew (10) as in claim 1, in which the positioning and guide means comprises a small guide wheel having a cylindrical edge.

4. Corkscrew (10) as in claim 1, in which the positioning and guide means comprises a small guide wheel containing a bevel oriented to be facing towards the top of the bottle when the positioning and guide means cooperates with the upper part of the neck of the bottle.

5. Corkscrew (10) as in claim 1, in which the positioning and guide means comprises a ledge protruding into the recess.

6. Corkscrew (10) as in claim 5, in which the ledge forms an inner end of the recess means.

7. Corkscrew (10) as in claim 1, in which a generating axis of a recess is normal to the flat segment of the grip.

8. Corkscrew (10) as in claim 1, in which a generating axis of the recess (19) is inclined in relation to a line normal to a flat segment of the grip.

9. Corkscrew as in claim 1, wherein each of said drawing screw and said short supporting element are pivotably anchored to said grip.

10. Corkscrew as in claim 1, wherein said recess is conformed as an arc of a circle, wherein said positioning and guide means comprises a ledge protruding into the recess and conformed as an arc of a circle, and wherein said at least one small shearing wheel and said ledge are arranged such that when said ledge is supported on an upper edge of a collar of the bottle said at least one small shearing wheel can shear the cap at an intermediate position along the collar.

* * * * *